US009940779B2

(12) United States Patent
To et al.

(10) Patent No.: US 9,940,779 B2
(45) Date of Patent: Apr. 10, 2018

(54) METHOD AND SYSTEM FOR A CARD GAME VARIANT OF A COMMUNITY-STYLE POKER GAME

(71) Applicant: TECHNEEK LTD., Calagary (CA)

(72) Inventors: Ritchie To, Calgary (CA); Dennis Tu, Calgary (CA); Pechsovann Austin Chheng, Calgary (CA)

(73) Assignee: TECHNEEK LTD., Calgary, Alberta (CA)

( * ) Notice: Subject to any disclaimer, the term of this patent is extended or adjusted under 35 U.S.C. 154(b) by 79 days.

(21) Appl. No.: 14/486,390

(22) Filed: Sep. 15, 2014

(65) Prior Publication Data

US 2016/0078718 A1 Mar. 17, 2016

(51) Int. Cl.

*G07F 17/32* (2006.01)
*A63F 1/00* (2006.01)
*A63F 3/00* (2006.01)

(52) U.S. Cl.

CPC ..... *G07F 17/3225* (2013.01); *A63F 1/00* (2013.01); *G07F 17/3272* (2013.01); *G07F 17/3276* (2013.01); *G07F 17/3293* (2013.01); *A63F 2001/005* (2013.01); *A63F 2003/00164* (2013.01)

(58) Field of Classification Search

CPC ..... G07F 17/3225; G07F 17/3272; G07F 17/3293; A63F 1/00
USPC ..... 463/13
See application file for complete search history.

(56) References Cited

U.S. PATENT DOCUMENTS 5,382,025 A * 1/1995 Sklansky ..... A63F 3/00157 273/292
5,632,485 A * 5/1997 Woodland ..... A63F 1/18 273/274
5,839,732 A * 11/1998 Guidi ..... A63F 1/00 273/292
5,928,081 A * 7/1999 Bochichio ..... A63F 1/00 273/292
6,561,897 B1 * 5/2003 Bourbour ..... A63F 1/12 273/149 R
6,955,599 B2 10/2005 Bourbour
7,029,011 B2 * 4/2006 Strong ..... G07F 17/3293 273/292

(Continued)

OTHER PUBLICATIONS

PCT Written Opinion of International Search Authority issued in connection with PCT/CA2015/050840 dated Nov. 30, 2015.

(Continued)

*Primary Examiner* — Omkar Deodhar
*Assistant Examiner* — Shaun-Kay Hall
(74) *Attorney, Agent, or Firm* — Dentons US LLP

(57) ABSTRACT

A card game that is a variant of a community card poker game is disclosed. The card game involves presenting a plurality of sets of hole cards to one or more players. One of the sets of hole cards includes at least one card being presented face down and at least one card being presented face up. The card game further includes receiving a hand bet made by a player on at least one of the sets of hole cards. Further, the card game includes presenting a plurality of community cards to the one or more players, and subsequently determining a highest-ranked poker hand for the game based on each of the sets of hole cards in combination with the community cards.

36 Claims, 9 Drawing Sheets

(56) References Cited

U.S. PATENT DOCUMENTS

| | | | | |
|---|---|---|---|---|
| 8,317,198 | B2 | 11/2012 | Noyes | |
| 2002/0125639 | A1* | 9/2002 | Wells | A63F 3/00157 273/274 |
| 2004/0075215 | A1* | 4/2004 | Snow | A63F 3/00157 273/292 |
| 2006/0205484 | A1* | 9/2006 | Nicastro | G07F 17/32 463/25 |
| 2007/0182098 | A1* | 8/2007 | Gordon | A63F 3/00157 273/292 |
| 2008/0122177 | A1* | 5/2008 | Kling | A63F 3/00157 273/292 |
| 2009/0121437 | A1* | 5/2009 | Snow | A63F 3/00157 273/303 |
| 2009/0298565 | A1* | 12/2009 | Tishler | A63F 3/00157 463/12 |
| 2011/0176364 | A1* | 7/2011 | Ogawa | G11C 11/5635 365/185.12 |
| 2011/0309579 | A1 | 12/2011 | Sholes | |
| 2012/0214567 | A1 | 8/2012 | Snow | |
| 2012/0280454 | A1* | 11/2012 | Snow | A63F 3/00157 273/292 |

OTHER PUBLICATIONS

Techneek Redefined (LinkedIn—http://ca.linkedin.com/in/techneek-redefined-418687a4), Poker Variant Table game developer (Third Eye Hold'em), Jan. 2013.

* cited by examiner

METHOD AND SYSTEM FOR A CARD GAME VARIANT OF A COMMUNITY-STYLE POKER GAME

CROSS-REFERENCE TO RELATED APPLICATIONS

This application is related to a U.S. Design Patent Application No. 29/502,327, entitled "Poker Game Playing Surface And Environment," filed concurrently herewith, which is incorporated herein by reference in its entirety.

FIELD OF THE INVENTION

The present invention relates generally to gaming, and more particularly to a community card poker game.

BACKGROUND

The game of poker is a card game that has gained a wide popularity. In addition to a standard poker game, numerous other poker variants exist. One of such poker variants is a popular community card game named Texas Hold'em.

In summary, in Texas Hold'em, each player is dealt two of so-called "hole" cards that are placed face down. During a series of betting rounds, five so-called "community cards" (or cards that are shared by all players) are eventually dealt and placed face up. A set of three of the community cards is referred to as "the flop," while two remaining ones are referred to as "the turn" and "the river," respectively. At the conclusion of the game, the best five-card hand is determined for each remaining player based on a combination of that player's hole cards and the community cards. The pot is awarded to a player that holds the best five-card hand or may be split between players that have the same best hand.

Entities, such as casinos, online game providers, and creators/distributors of gaming applications welcome new content and types of games and game delivery systems in order to increase their return derived from gaming activities. In addition, new game variants which speed up play or result in a greater number of hands being played are also useful and needed by the gaming industry. Players, on the other hand, seek games that are engaging and provide multiple betting opportunities for a chance to maximize their potential winnings What is needed is a new type of poker game with multiple betting opportunities and a distinct appearance that may be offered on a table in a casino environment, a virtual table, a mobile device, a personal computer, a tablet or other client device.

SUMMARY

The systems and methods described herein provide a new poker game variant with multiple betting opportunities and a distinct appearance that may be offered for play on a physical table in a casino environment or on a virtual table on various kinds of user devices (e.g., a mobile device, a personal computer, a tablet, a dedicated gaming machine, or any other suitable user device). In particular, the systems and methods described herein provide a card game that is a variant of a community-style poker game using shared community cards, such as Texas Hold'em. The disclosed variant can provide a fast-paced engaging experience for a player. In turn, an improved player experience can yield higher returns for the house through recurring gameplay.

In one embodiment, a computer-implemented method for playing a card game is provided. The method includes providing, by at least one gaming processor, a plurality of sets of hole cards for presentation to one or more players, where one of the plurality of sets of hole cards includes at least one card being presented face down and at least one card being presented face up. The method further includes receiving, by the at least one gaming processor, a hand bet made by a player on one of the plurality of sets of hole cards. The method also includes providing, by the at least one gaming processor, a plurality of community cards for presentation to the one or more players. Additionally, the method includes determining, by the at least one gaming processor, a highest ranked poker hand for the game based on each of the plurality of sets of hole cards in combination with the plurality of community cards.

In another embodiment, a gaming apparatus for playing a poker style card game is provided. The gaming apparatus includes a gaming surface configured to present at least one player with a plurality of community cards and a plurality of sets of two or more hole cards and to accept from the at least one player betting indicia in accordance with the card game, at least one of the plurality of sets of two or more hole cards including at least one card being displayed face down and at least one card being displayed face up. The gaming surface has a plurality of betting areas including (a) a hand bet betting area configured to accept at least one hand bet from the at least one player on at least one of the plurality of sets of two or more hole cards, and (b) a blind eye bonus betting area configured to accept a blind eye bonus bet qualifying the at least one player to be eligible for receiving a payout irrespective of folding by the at least one player. The gaming surface is further to configured to present the at least one player: (a) with at least one of the plurality of community cards after the at least one hand bet is received from the at least one player, (b) at a conclusion of at least one dealing and betting round, with a highest ranked poker hand for the card game based on one or more sets of the two or more hole cards in combination with the plurality of community cards, and (c) with a game result based on a determination whether the at least one hand bet is part of the highest ranked poker hand.

In yet another embodiment, a method for playing a poker style card game is provided. The method includes presenting at least one player with a plurality of community cards and a plurality of sets of two or more hole cards, accepting from the at least one player betting indicia in accordance with the card game, at least one of the plurality of sets of two or more hole cards including at least one card being displayed face down and at least one card being displayed face up. The method further includes accepting at least one hand bet from the at least one player on at least one of the plurality of sets of two or more hole cards, and accepting a blind eye bonus bet qualifying the at least one player to be eligible for receiving a payout irrespective of folding by the at least one player. The method further includes presenting the at least one player (a) with at least one of the plurality of community cards after the at least one hand bet is received from the at least one player, (b) at a conclusion of at least one dealing and betting round, with a highest ranked poker hand for the card game based on one or more sets of the two or more hole cards in combination with the plurality of community cards, and (c) with a game result based on a determination whether the at least one hand bet is part of the highest ranked poker hand.

Additional features and advantages of embodiments will be set forth in the description which follows, and in part will be apparent from the description. The objectives and other advantages of the invention will be realized and attained by the structure particularly pointed out in the example embodiments in the written description and claims hereof as well as the appended drawings. It is to be understood that both the foregoing general description and the following detailed description are illustrative and explanatory and are intended to provide further explanation of the invention as claimed.

BRIEF DESCRIPTION OF THE DRAWINGS

Various embodiments of the present invention are illustrated by way of example and are not limited to the following figures.

DETAILED DESCRIPTION

Various embodiments and aspects of the invention will be described with reference to details discussed below, and the accompanying drawings will illustrate the various embodiments. The following description and drawings are illustrative of the invention and are not to be construed as limiting the invention. Numerous specific details are described to provide a thorough understanding of various embodiments of the present invention. However, in certain instances, well-known or conventional details are not described in order to provide a concise discussion of embodiments of the present invention.

Further, although a card game in accordance with embodiments of the present invention may be played in a live form, such as with a live dealer and a physical game table, in a preferred embodiment, the card game is a computer-implemented game that may be played in an electronic or video form, such as using electronic or virtual representations of cards and a game table displayed on a graphic user interface ("GUI") on a user's gaming device. Examples of such user gaming devices include a desktop computer, a portable computer (e.g., a laptop), a portable hand-held device (e.g., a mobile phone, a smart phone, or a tablet), and/or a dedicated gaming machine/terminal (e.g., an electronic gaming machine connected to a casino electronic gaming network). Accordingly, the card game in accordance with the embodiments of the present invention may be played for wagers placed in person or electronically. Additionally, it may be operated in a play-for-free version utilizing free chips in a casino environment or virtual chips if the game is played on an electronic gaming device.

Game Rules

Figure 1:
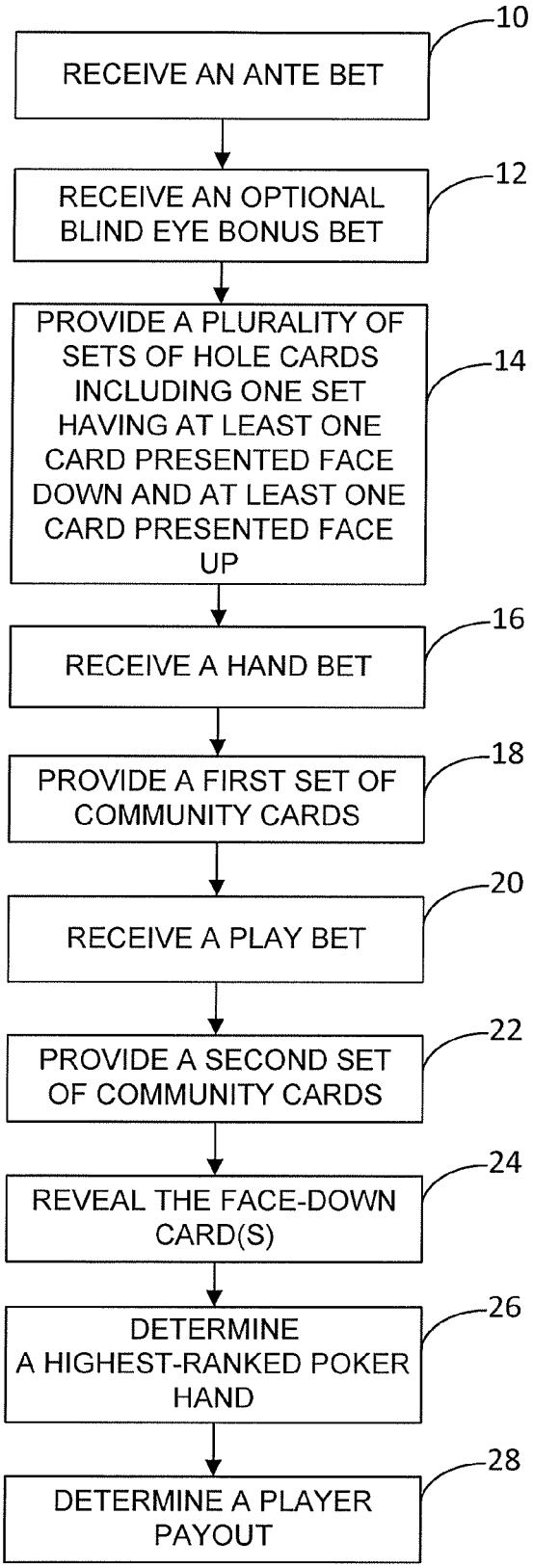
FIG. 1 is a flow chart showing a set of functions that is carried out in a method of playing a card game in accordance with an illustrative embodiment.

FIG. 1 is a flow chart showing a set of functions that are carried out in a method of playing a card game in accordance with one illustrative embodiment.

As a general matter, the game may use a standard fifty-two card deck shuffled after every round, wherein the object of the game is for one or multiple players to play against the house and place a bet on a highest-ranked card combination, as further discussed below. Further, unlike, for instance, Texas Hold'em, in which multiple players compete against each other for a single pot, in accordance with one embodiment of the present disclosure, each player plays individually against the house and hence a single player may participate in the game.

Figure 4A:
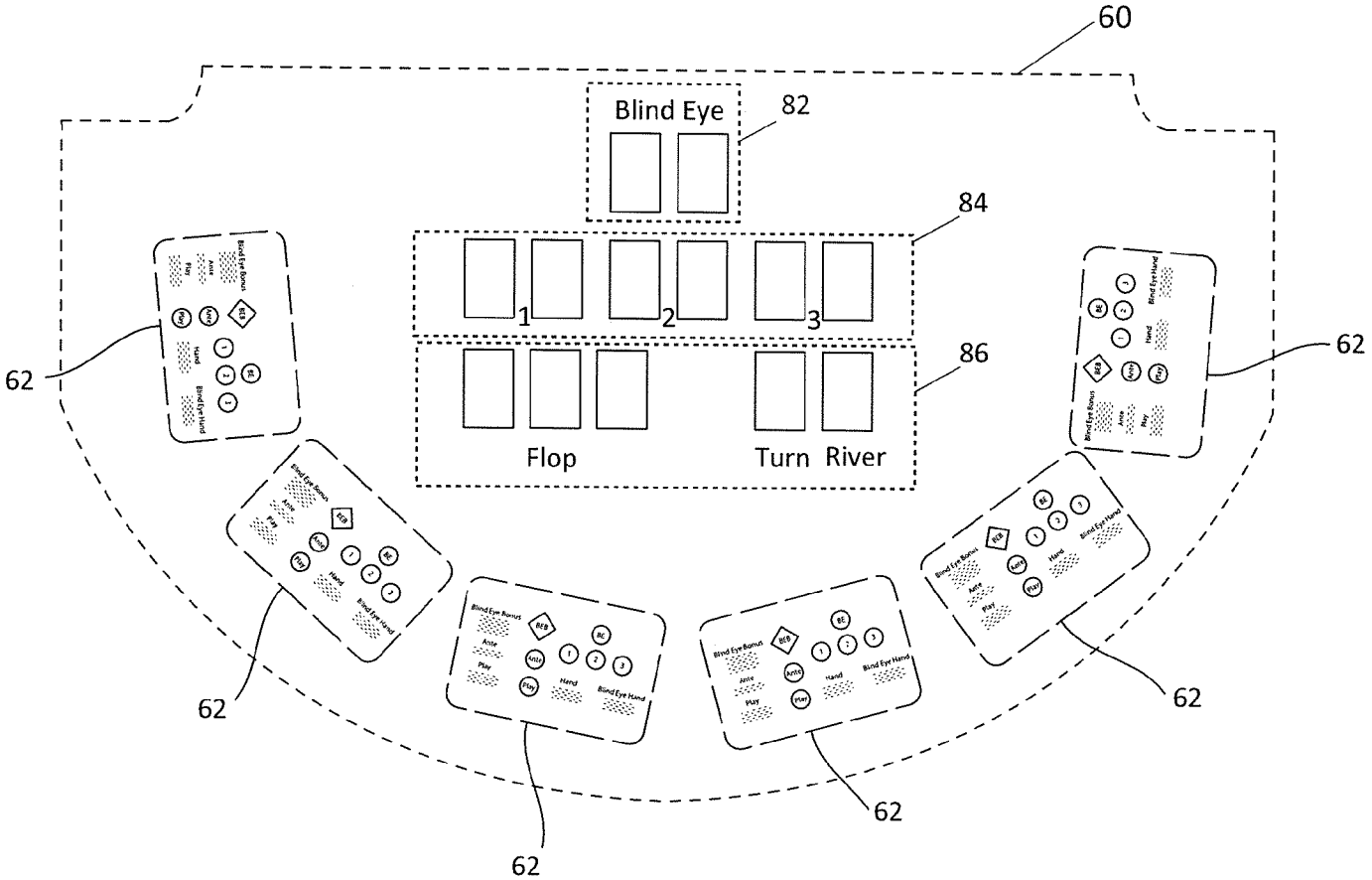
FIG. 4A depicts one example of a layout for a game table that is used in playing the card game in accordance with the illustrative embodiment of FIG. 1.
Figure 4B:
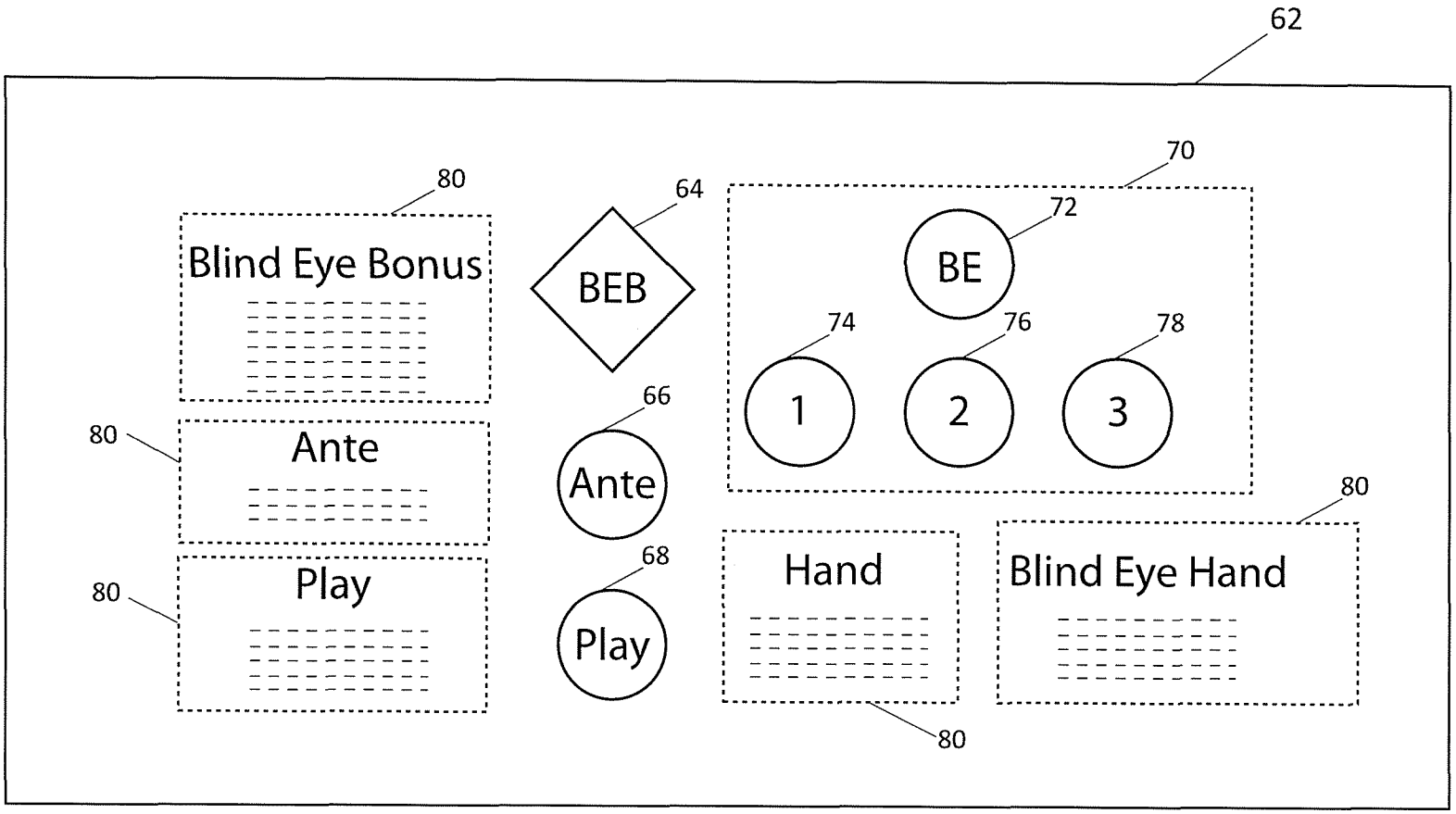
FIG. 4B shows in greater detail a betting area of the game table of FIG. 4A.

As shown in FIG. 1, in accordance with the illustrative embodiment, at step 10, the game begins by receiving from each of one or more players an initial bet or so-called an "ante" necessary to join the first hand of play (referred hereafter as an "ante bet"). Also, in step 12, a player may elect to make an optional bonus bet called the "Blind Eye Bonus" bet. The Blind Eye Bonus bet is made prior to dealing of a plurality of sets of hole cards. The Blind Eye Bonus bet is wagered by a player by placing or designating, such as via an electronic gaming device, a bet in a Blind Eye Bonus bet spot of a game table as shown in FIGS. 4A-4B. As will be discussed in more detail below, by making the Blind Eye Bonus bet, a player may be able to receive a payout regardless of whether the hole cards the player chooses to bet on win or lose.

Next, in step 14, the plurality of sets of hole cards are dealt by being provided for presentation to the player(s) on the game table. As used herein, the term "set of hole cards" generally refers to multiple hole cards that are used in combination with a plurality of community cards to determine a highest-ranked poker hand at the conclusion of the game, as described below. Note that the terms "set of hole cards" and "hole-card set" will be used herein interchangeably.

Figure 3:
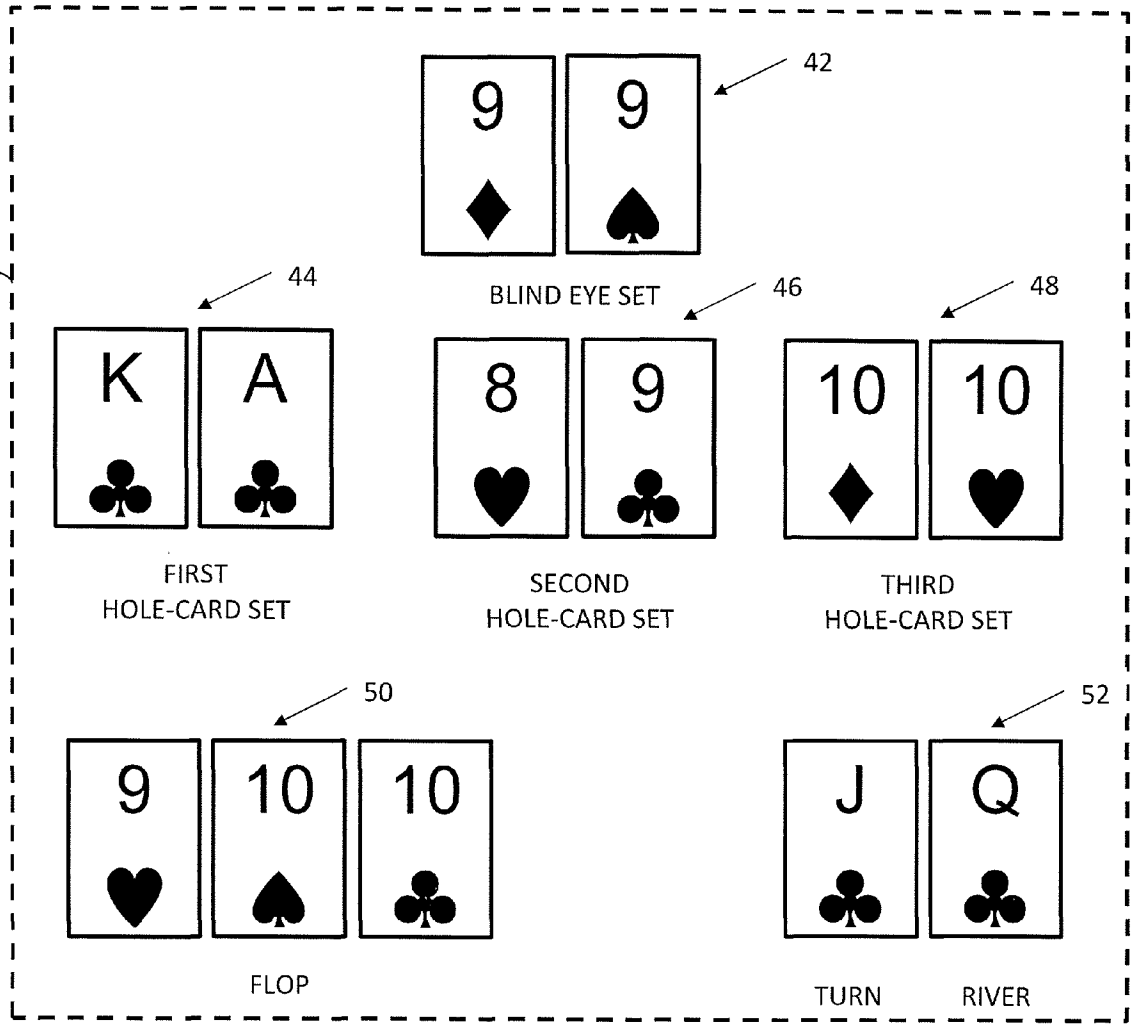
FIG. 3 shows one particular example of a card arrangement used in playing the card game in accordance with the illustrative embodiment of FIG. 1

In the illustrative embodiment, the plurality of sets of hole cards are provided for presentation to all of the player(s) participating in the game, as opposed to being dealt individually to each player. In this regard, the plurality of sets of hole cards may be, for example, positioned on respective designated areas of the game table for display to the participating player(s), as shown in FIGS. 3, 4A and discussed in more detail below.

Figure 2:
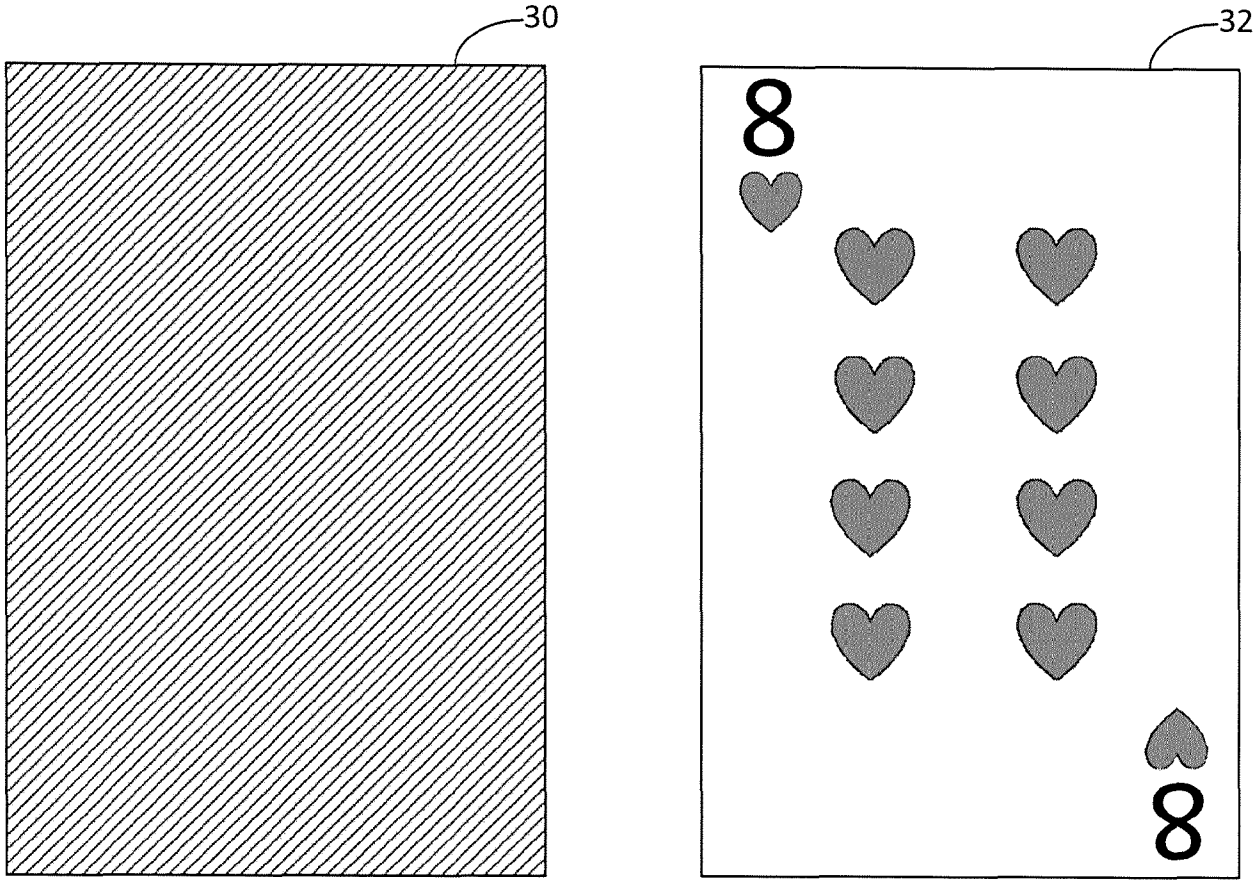
FIG. 2 depicts one example of the Blind Eye set in accordance with the illustrative embodiment.

In accordance with an embodiment of the present disclosure, the plurality of sets of hole cards include at least one set of hole cards having at least one card presented face down and at least one card presented face up. The set of hole cards with at least one card that is presented face down and at least one card that is presented face up is referred to as the "Blind Eye set." FIG. 2 shows an example of the Blind Eye set including at least one card 30 that is presented face down and at least one card 32 that is presented face up.

Note that, in the illustrative embodiment, the plurality of sets of hole cards are four sets of hole cards, and each set of hole cards is made up of two cards. With the exception of the Blind Eye set, which includes one card being face down and one card being face up, the remaining three sets of hole cards are presented with all cards face up. For the purpose of example, each of the remaining sets of hole cards will be referred to respectively as a "First Hole-Card set," a "Second Hole-Card set," and a "Third Hole-Card set."

However, in other embodiments, the Blind Eye set and/or the three remaining sets of hole cards can each be made up of more than two cards, where the cards in the Blind Eye set include at least one card being presented face down and at least one card being presented face up. Further, in other embodiments, more or fewer than four sets of hole cards may be dealt, as long as those sets of hole cards include at least one Blind Eye set as set forth above.

As a general matter, one of the objects of the game is for a player to select and bet on the set of hole cards which, out of all the available sets of hole cards, will result in a highest-ranked poker hand for the game when that set of hole cards is combined with community cards. Hence, after all of the sets of hole cards are dealt and displayed, the one or more players make a bet on one of the four available sets of hole cards. Hence, step 16 involves receiving from the player(s) a bet on one of the plurality of sets of hole cards. This bet, placed by a player on one of the sets of hole cards or otherwise selected via an electronic gaming device (e.g., via a GUI on the electronic gaming device), will be referred herein as a "hand bet." In the illustrative embodiment, a player makes the hand bet on one of the four hole-card sets, including the Blind Eye set. In one example, this bet is a predetermined integer multiple of the ante bet, such as 1×, 2×, or 3× the ante bet. However, the game or a system executing the game may be configured to allow other hand bet amounts. In the illustrative embodiment, a player may choose to fold by electing not to bet on one of the available hole-card sets, which forfeits his or her ante bet and, if made, his or her Blind Eye Bonus bet.

At step 18, after the hand bet, a first set of community cards is provided for presentation to the player(s) on the game table. In the illustrative embodiment, this set is a three-card set commonly referred to as "the flop," and each card in the first set of community cards is dealt face up. Alternatively, the first set of community cards differs from the traditional flop, and has fewer than or more than three cards. In a preferred embodiment, the community cards in the first set are positioned on a designated area of the game table for display to the player(s), as shown in FIG. 3A and discussed in more detail below.

After the first set of three community cards is dealt, the player(s) make another bet, referred herein as a "play bet," or a flop bet. Alternatively, the player(s) may elect to fold. Thus, at step 20, a play bet is received from one or more players. In one example, a player makes the play bet by placing a bet equal to the ante bet, although the system or game may be configured to require any minimum amount necessary to stay in the game, and may also be configured to allow the player to bet an amount greater than the ante or up to a predetermined maximum.

In the illustrative embodiment, any player who does not make the play bet folds at this point in the game. As a result, that player forfeits the ante bet and the hand bet. The Blind Eye bonus bet, on the other hand, is still in play. Advantageously, even if the player does not make the play bet, that player can still remain in the game if he/she made the optional Blind Eye bonus bet. If the game has only one player, and that player does not make the play bet and also has not made the Blind Eye bonus bet, the game ends.

After the play bet, at step 22, a second set of community cards is provided for presentation to the player(s) on the game table. In the illustrative embodiment, this is a set of two cards commonly referred to as "the turn" and "the river," and each card in the second set of community cards is dealt face up. The second set of community cards may be positioned in a designated area of the game table for display to the player(s), as shown in FIG. 3A and discussed in more detail below.

In a preferred embodiment, both the "turn" and "river" cards are dealt together in the same round. One benefit of dealing the "turn" and "river" cards at the same time is that the game can progress at a faster pace. This encourages additional rounds of play, and hence can generate higher return for the house. Also, a faster-paced game can provide a more engaging experience for a player.

Note, however, that in an alternative embodiment, the "turn" card and the "river" card may be dealt separately, so that the player(s) have additional betting opportunities. For example, after the "turn" card is dealt, a player can make another bet before the "river" card is dealt. In another alternative embodiment, all of the community cards (e.g., all of the five community cards) for the game may be dealt at the same time. In yet another alternative embodiment, after all of the community cards are dealt, the players have an opportunity to place an additional bet before the face down card(s) in the Blind Eye set is revealed.

In the illustrated embodiment, after all of the community cards have been dealt, at step 24, the face-down card of the Blind Eye set is revealed, and at step 26, a highest-ranked poker hand for the game, or a winning hand, is determined based on each of the plurality of sets of hole cards in combination with the plurality of community cards.

To illustrate, in the embodiment of FIG. 1, for each hole-card set, the two cards making up that hole-card set and the five community cards may be used in any combination of five total cards to determine a highest-ranked poker hand for the respective hold-card set. Hence, it is possible that for a given hole-card set made up of two cards, the highest-ranked poker hand consists solely of the five community cards, two hole cards and three community cards, or one hole card and four community cards. Then, the highest-ranked poker hands associated with respective sets of hole cards are compared with each other to determine the highest-ranked poker hand for the game as the winning hand. A set of hole cards that makes the winning hand will be a winning hole-card set.

In this regard, note that it is possible that the overall highest-ranked poker hand at the end of the game will consist entirely of the plurality of community cards. This is a case of a so-called "board-play," in which player bets are "pushed back," or returned back to the player. In the case of the board play, no set of hole cards, when combined with the plurality of community cards, makes a poker hand that has a higher ranking than a poker hand made entirely out of the community cards.

In another scenario, more than one of the plurality of sets of hole cards can make the winning hand. In this situation, those hole-card sets may be all considered to be "winning" In other words, there is essentially a "tie" between multiple hole-cards sets. Unlike in Texas Hold'em, for instance, in which normally players who hold the same best hand for the game end up splitting a single pot, in one embodiment, any player(s) who placed the hand bet on any one of the hole-card sets that made the winning hand, will be entitled to a full payout in accordance with a predetermined payout for the hand bet.

In the illustrative embodiment, the highest-ranked poker hand is determined based on a plurality of predetermined poker hand rankings Table 1 below shows one typical example of poker hand rankings used to determine rank, from highest to lowest, of five-card poker hands.

TABLE 1

| Poker Hand Ranking | Hand Description |
|---|---|
| Royal Flush | Ace, King, Queen, Jack and Ten in the same suit |
| Straight Flush | Five cards in sequence of the same suit |
| Four of a Kind | Four cards of the same rank with a kicker (a single card) |
| Full House | Three of a Kind and a Pair |
| Flush | Any five cards of the same suit not in sequence, ranked by high card |
| Straight | Five cards in sequence and not all of the same suit |
| Three of a Kind | Three cards of the same rank and two kickers |
| Two Pair | Two different sets of pairs and a kicker ranked by high card |
| Pair | Two cards of the same rank and three unrelated cards as kickers ranked by high card |
| High Card | Highest card of five cards. If players each have the same highest card, winner determined by next highest card, etc. |

Finally, at step 28, a payout, if any, is determined for any player that remains in the game. If, during the hand bet, a player selected the set of hole cards that makes the winning hand, that player is paid out according to predetermined odds, as set forth below. If, however, a player did not select the set of hole cards that makes the winning hand, that player loses his or her ante bet, hand bet, and play bet, with the exception of the case of the board play (as discussed above).

Game Results

The following description provides some non-limiting examples of how payouts may be determined in one preferred embodiment based on odds applied to bet(s) that a player made during the game. As those skilled in the art will realize, odds may be varied or changed to other predetermined odds at any time prior to a players' decision to join the game and placing an ante. Alternatively or in addition, those skilled in the art will also realize that various other card combinations from those set forth below are within the scope of the present disclosure.

Ante Bet

If a player selected any one of the First Hole-Card set, the Second Hole-Card set, and the Third as a set that made the winning hand, a payout on the ante bet is 2:1, as may be shown in a payout table 80 entitled "Ante" in FIG. 4 B. If a player selected the Blind Eye set as a set that made the winning hand, the payout on the ante bet is 4:1, as may be shown in a payout table 80 entitled "Blind Eye Hand" in FIG. 4B.

Hand Bet

If a player selected any one of the four hole-card sets that made the winning hand, a payout on the hand bet is 1:1, as may be shown in a payout table 80 entitled "Hand" in FIG. 4B.

Play Bet

If a player selected any one of the four hole-card sets that made the winning hand, a payout on the play bet is determined according to a payout table, an example of which is shown in Table 2 below and may also be reproduced on the game surface in a payout table 80 entitled "Play" in FIG. 4B.

TABLE 2

| Play Bet Paytable | |
|---|---|
| Winning Hand | Payout |
| Royal Flush | 500 to 1 |
| Straight Flush | 35 to 1 |
| Four-of-a-Kind | 25 to 1 |

TABLE 2-continued

| Play Bet Paytable | |
|---|---|
| Winning Hand | Payout |
| Full House | 7 to 1 |
| Flush | 5 to 1 |
| Straight | 4 to 1 |
| Other | Push |

Blind Eye Bonus Bet

A player that placed a Blind Eye Bonus bet in a Blind Eye Bonus bet spot 64 (FIG. 4B), wins when their hand bet on any hole card set resulted in a poker hand combination with the community cards of a Three of a Kind or better. A player benefits by taking the option to make the Blind Eye bonus bet because he or she receives an opportunity for a payout regardless of whether the hole-card set he or she placed a bet on wins or loses the game, or whether the winning hand for the game uses the board (i.e., consists entirely of the community cards). A payout on the Blind Eye Bonus bet is determined according to a payout table, example of which is shown in Table 3 and which may be reproduced on the game surface in a payout table 80 entitled "Blind Eye Bonus" in FIG. 4B.

TABLE 3

| Blind Eye Bonus Paytable | |
|---|---|
| Winning Hand | Payout |
| Royal Flush | 40 to 1 |
| Straight Flush | 30 to 1 |
| Four of a Kind | 25 to 1 |
| Full House | 11 to 1 |
| Flush | 5 to 1 |
| Straight | 4 to 1 |
| Three of a Kind | 2 to 1 |
| Other | Loss |

In an alternative embodiment, however, the rules of the game may be set such that the Blind Eye Bonus bet does not pay out when a player folds by not making the play bet.

Board Play

If the winning hand consists entirely of the community cards, player's bets are pushed back. However, the Blind Eye Bonus bet is paid according to Table 3 above.

Example of Game Play

The following is one particular example of playing the card game, whether on a physical or virtual game surface such as a game table, in accordance with the illustrative embodiment described above. In a preferred embodiment, the illustrated game play scenario assumes four players participating in the game, four hole-card sets each made up of two cards, and five community cards. Further, the example illustrates the state of the game at the point when the face-down card in the Blind Eye set has been revealed (such at step 24 in the FIG. 1).

FIG. 3 shows a game table 40 having thereon a Blind Eye set 42, a First Hole-Card set 44, a Second Hole-Card set 46, a Third Hole-Card set 48, a first set of community cards 50 (e.g., the flop cards) and a second set of community cards 52 (e.g., the turn and river cards). The rank and the suit of each card in each respective set of cards is shown in FIG. 3 and provided for reference below in the format of [Rank, Suit]:

Blind Eye Set 42: [Nine, Diamond], [Nine, Spade]

First Hole-Card Set 44: [King, Club], [Ace, Club]

Second Hole-Card Set 46: [Eight, Heart], [Nine, Club]

Third Hole-Card Set 48: [Ten, Diamond], [Ten, Heart]

First Set of Community Cards 50: [Nine, Heart], [Ten, Spade], [Ten, Club]

Second Set of Community Cards 52: [Jack, Club], [Queen, Club]

Players 1-4 place the bets as shown in Table 4 below:

TABLE 4

| PLAYER | Hand Bet Spot | Blind Eye Bonus Bet | Ante Bet | Hand Bet | Play Bet |
|---|---|---|---|---|---|
| ONE | First Hole-Card Set | 5.00 | 5.00 | 5.00 | 5.00 |
| TWO | Second Hole-Card Set | 5.00 | 5.00 | 5.00 | 5.00 |
| THREE | Third Hole-Card Set | 5.00 | 5.00 | 5.00 | 5.00 |
| FOUR | Blind Eye Set | 5.00 | 5.00 | 5.00 | 5.00 |

Note that in Table 4, the "Hand Bet Spot" indicates a respective hole-card set on which a given player places his or her hand bet. Further, the amounts each player bets are provided for purpose of example only, and can be in any desired format such as a number of chips, units of currency, including hard currency, cryptocurrency such as Bitcoin, virtual currency, number of points, or free play may be implemented. In an alternate embodiment, multiple hand bets can be made, including betting on flop, turn, and river cards.

As shown in FIG. 3, when the First Hole-Card Set 44 is combined with the first and second sets of community cards 50 and 52, a highest-ranked poker hand resulting from those cards is the Royal Flush. When the Second Hole-Card Set 46 is combined with the first and second sets of community cards 50 and 52, a highest-ranked poker hand resulting from those cards is the Straight. When the Third Hole-Card Set 48 is combined with the first and second sets of community cards 50 and 52, a highest-ranked poker hand resulting from those cards is the Four of a Kind. Finally, when the Blind Eye Set 42 is combined with the first and second sets of community cards 50 and 52, the highest-ranked poker hand resulting from those cards is the Full House.

To determine the highest-rank poker hand for the game, the highest-ranked poker hands corresponding respectively to the First Hole-Card 44, the Second Hole-Card set 46, the Third Hole-Card set 48, and the Blind-Eye set (i.e., the Royal Flush, Straight, Four of a Kind, and Full House hands) are compared with each other to determine which one of those hands ranks highest. Since the hand that makes the Royal Flush has the highest ranking, it is the winning hand for the game.

As such, the First Hole-Card set 44 is the winning hole-card set for the game, and Player 1 who placed the hand bet on the First Hole-Card set 44 will be paid out on his or her ante, hand, and play bets. For example, according to the payout schemes given above, a payout for Player 1 on the ante bet will be 2:1, on the hand bet will be 1:1, and on the play bet will be 500:1. Further, as described above, a player will be paid out on the Blind Eye Bonus bet if the hole-card set selected as his or her hand bet results in a poker hand of the Three of a Kind or better, or if the winning hand uses the board and is the Three of a Kind or better. Hence, in this particular example, all of the Players 1-4 will be paid on their Blind Eye Bonus bets (e.g., according to the Blind Eye Bonus payout table shown above).

Game Table

FIG. 4A depicts one example of a layout for a game table 60 that is used in playing the card game in accordance with the illustrative embodiment of FIG. 1.

In one embodiment, the game table 60 is a virtual table that may be displayed to a player on a user device equipped with suitable interface(s) (e.g., an LCD display screen, a video screen, or the like). In additional embodiments, the game table 60 is a physical table having a physical gaming surface with marked betting and dealing areas or a physical table equipped with a gaming surface in the form of an electronic display presenting a graphical user interface representation of betting areas and dealing areas as discussed in further detail below.

As shown in FIG. 4A, the game table may include a number of betting areas 62 each associated with an individual player. FIG. 4B shows in more detail an example of a layout of each betting area 62. As shown in FIG. 4B, each betting area 62 may include designated spots for placing respective bets, such as a Blind Eye Bonus bet spot 64, an ante bet spot 66, a play bet spot 68, and a hand bet spot 70. Further, an area designated for the hand bet spot 70 may further include respective separate spots 72-78 for placing bets on the Blind Eye set, the First Hole-Card set, the Second Hole-Card set, and the Third Hole-Card set. Also, the game table 60 may include indications of payouts for each respective bet. As an example, in FIG. 4B, payout information 80 (e.g., a payout table) associated with a given bet may be shown to a player within each betting area 62 of the table 60.

In one example, cards may be arranged on the table 60 within respective dealing areas 82-86. In one embodiment, the dealing area 82 designated for the Blind Eye set may include a spot designated for a card to be presented face down and a spot designated for a card to be presented face up. Each of the respective designations for a face-down card and a face-up card may be in the form of any suitable visual indicator (e.g., a graphical and/or textual indicator). Of course, if the Blind Eye set is made up of more than two cards, the dealing area 82 designated for the Blind Eye set may include at least one spot designated for a card to be presented face down and at least one spot designated for a card to be presented face up.

As shown in FIG. 4A, the dealing areas 82-86 may be arranged on the table 60 in a graphically hierarchical structure, with the dealing area 82 for the Blind Eye set being arranged at the uppermost level. The dealing area 84 for the First Hole-Card set (shown in FIG. 4A as "1"), the Second Hole-Card set (shown in FIG. 4A as "2"), and the Third Hole-Card set (shown in FIG. 4A as "3") is then arranged at a level below the Blind Eye set. Each of the three hole-card sets in the dealing area 84 may be physically spaced from each other so that a player can easily distinguish between individual hole-card sets.

In turn, the dealing area 86 for the two sets of community cards, i.e., the flop, the turn, and the river cards are arranged at the lowermost level. The two sets of community cards may be physically spaced from each other, as shown in FIG. 4A.

Note, however, that the table layout and card arrangement are not limited to the ones shown in FIG. 4A, and other variations are possible. In addition, although FIG. 4A shows an arrangement associated with four hole-card sets, a similar arrangement may be employed with a different number of hole-card sets.

General System Arrangement

Figure 5:
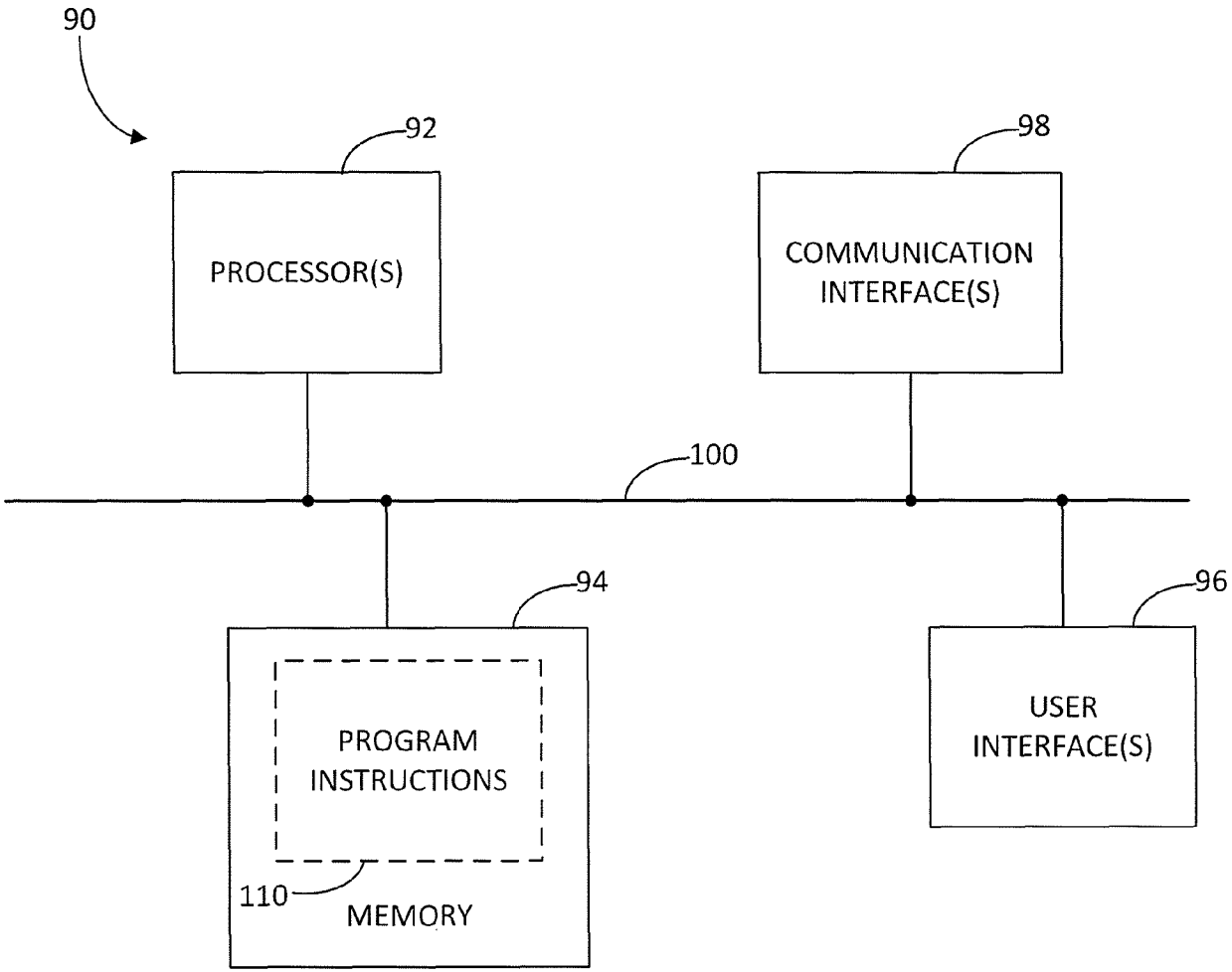
FIG. 5 is a block diagram of a generalized system arranged in accordance with one embodiment.

FIG. 5 is a simplified block diagram of a system 90 arranged to carry out various functions described herein, such as in FIGS. 1-2B above, in accordance with an embodiment. As shown in FIG. 5, the system 90 includes one or more processors 92, memory 94, user interface(s) 96, as well as communication interface(s) 98, all coupled together via suitable mechanism(s) 100 (e.g., a system bus, wired and/or wireless communication link(s), or other the like).

The components depicted in FIG. 5 are shown for purpose of example only, and other components than those shown may be included or used instead. In addition, individual components may be located within a single functional unit (e.g., a client device) or may be divided among a plurality of functional units (e.g., a gaming server and a client device) that may be physically separated from one another. For example, the memory 94 may be located in a physically separate location from the processor(s), with a means for connecting the memory 94 and the processor(s) 92. As another example, the processor(s) 92 may comprise multiple processors distributed among different functional entities physically separated from each other. Similarly, the memory 94 may comprise multiple data storage locations distributed among different functional entities physically separated from each other. Other variations are possible as well.

In an embodiment, the processor(s) 92 may be dedicated processor(s), such as gaming processor(s), configured to execute computer readable program code. The memory 320 may be volatile or non-volatile non-transitory computer readable medium or media, now known or later developed. The memory 94 may hold program logic comprising program instructions 110 (e.g., machine language instructions) executable by the processor(s) 92 to carry out various functions described herein. Additionally, the memory 94 may store any other data, such as data used by the processor(s) in the execution of the program instructions 110 (e.g., a database storing payout tables). However, any additional data may be also be held in other data storage location(s) separate from the memory 94.

The communication interface(s) 98 may generally couple the system 90 to communication network(s) and allow the system 90 to transmit and receive communications from/to the communication network(s). For example, the program instructions 110 and/or other data held in the memory 94 may be modified and/or updated via the communication interface(s) 98 as needed.

The user interface(s) 96 may include any suitable interface for receiving user inputs (e.g., inputs indicative of bet(s) placed by a player) (e.g., a touch screen, buttons, keyboard, among others), displaying various content to a user (e.g., graphical representations of a game table and cards, an indication of a winning hand and a payout amount), and providing/facilitating any other aspects of user interaction as discussed herein. As those skilled in the art will realize, various embodiments of the system described herein include, but are not limited to, an arrangement wherein graphics are stored on a client device, whether pushed from a server via a download or invoked via a locally stored application. Additionally, the client device includes a processor and associated communication interface for generating, sending, and receiving specific commands and messages associated with gameplay described herein, such as fold, bet, and card selection commands, among others.

Example of a Gaming Network

Figure 6:
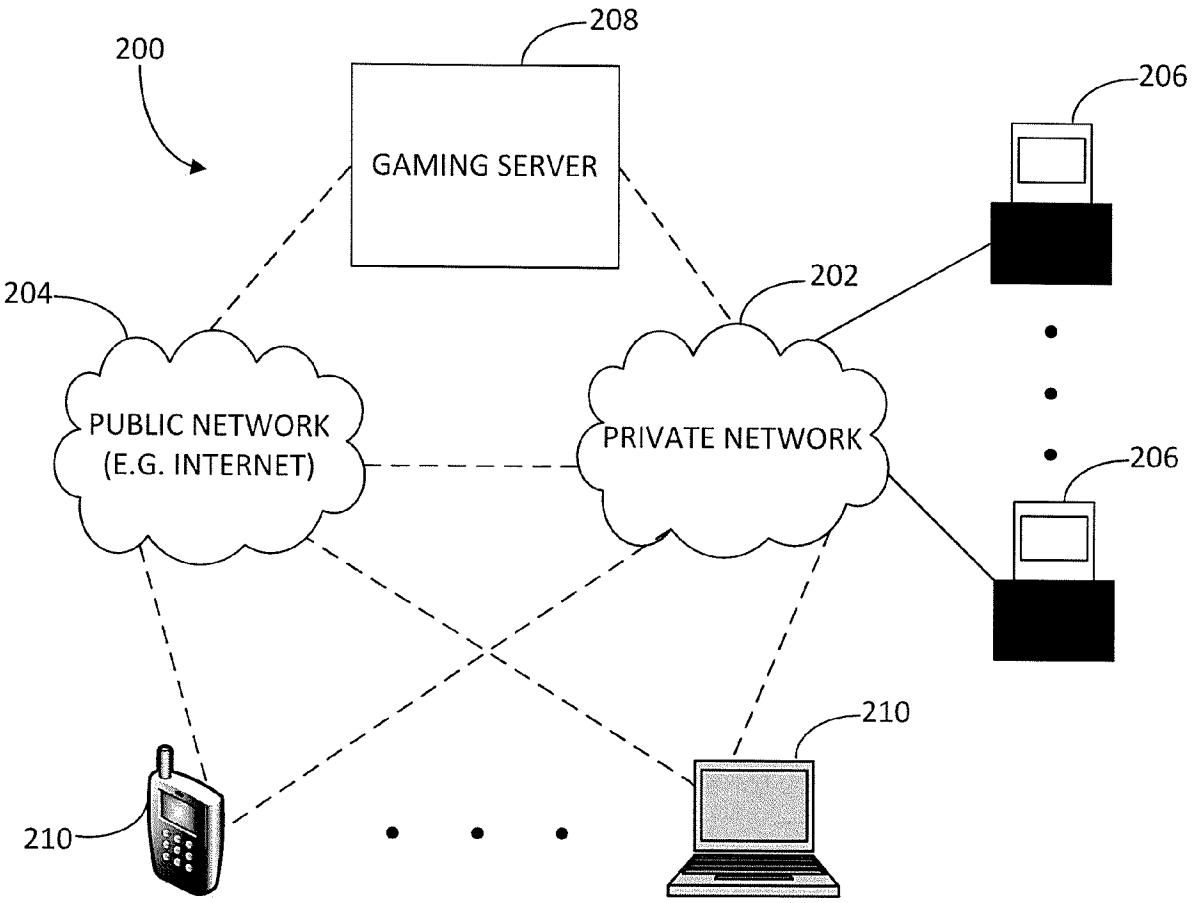
FIG. 6 is a block diagram of one example of gaming network in which the system of FIG. 5 is implemented, in accordance with one particular embodiment.

FIG. 6 illustrates a schematic diagram of an example gaming network 200 in which the system 90 is implemented, in accordance with one particular embodiment.

As shown in FIG. 6, the gaming network 200 includes a private network 202, a public network 204 (e.g., the Internet), a number of gaming machines 206 coupled to the private network 202, a gaming server 208 that may be communicatively coupled with the private network 202 and/or the public network 204, and a number of user devices 210. The private network 202 and the public network 204 may be interconnected via appropriate interfaces, including wireless and/or wired interfaces.

In general, the private network 202 may be any type of a landline and/or wireless network (e.g., a wired local area network (LAN) and/or a wireless local area network (WLAN), such as a Wi-Fi network or the like, and may be deployed by a private entity, such as a casino for instance. The gaming terminals 206 are coupled to the private network 202 and are, for example, in the form of electronic gaming machines or card tables equipped with a gaming surface in the form of an electronic-type of display. In one embodiment, the private network 202 is a dedicated casino network coupled to the gaming server 208, and the gaming terminals 206 are located on a casino floor for example. The gaming server 208 may be located in the casino or in a remote location, including at a network operation center of a gaming network operator.

The user device 210 is equipped with suitable user interface(s) (e.g., a keypad, a keyboard, touch screen, mouse, a microphone, a display presenting a graphical user interface) to facilitate interaction with a user, and may take on a variety of different forms, including, but not limited to landline computer(s) (e.g., a personal computer), wireless computer(s) (e.g., a laptop), handheld wireless/mobile device(s) (e.g. a mobile/cellular/smart phone, a personal digital assistant (PDA), a tablet and/or any other suitable device(s). Yet additional embodiments of the user device include single-player and multi-player gaming kiosks and gaming tables, including an electronic gaming table presenting a graphical user interface having the dealing and betting areas discussed above.

In the illustrated embodiment, the user device 210 is coupled to the private network, such as a dedicated casino network, through any suitable communication links and/or intermediate networks, such as a wireless cellular network, a WLAN, a wired network, including a LAN, and communicates via any suitable communication protocols. Examples of communication protocols include CDMA 2000 1×, 1×EV-DO, 1×EV-DV, GSM, GPRS, EDGE, HSPDA, UMTS, LTE (3GPP Long Term Evolution), UMB (Ultra Mobile Broadband), and WiMAX, among others.

In one example, the gaming server 208 and the gamine machine 206 are programmed accordingly, such as with the processor(s) 92 and the memory 94, to allow a player to access and play the card game in accordance with the embodiments disclosed herein. The gaming server 208 is programmed to execute a set of server-side based functions, such as dealing cards and sending indication of dealt cards for presentation on the gaming machine 206, determining the winning hand, and determining each player's payout, for example. The gaming machine 206, on the other hand, is programmed to execute a set of client-side based functions, such as providing an indication of player's bets to the gaming server 208, presenting cards to player(s), and receiving player's inputs, for example. In one scenario, players at multiple gaming machines 206 participate in the same game.

However, in other examples, the entire game program logic (e.g., the program instructions 110 held in the memory 94) could also or instead be embedded entirely within the gaming machine 206, such as in a scenario in which only one player is playing the game.

The card game according to the embodiments disclosed herein is similarly played on the user devices 210. In one example, the user device 210 could, e.g., communicate with the gaming server 208 sitting on either the private network 202 or the public network 204, such as the Internet. For example, the user device 210 may be in the form of a portable device that could connect to the gaming server 208 siting on the private network 202, such as at the casino for instance, via a suitable access mechanism (e.g. a Wi-Fi access point).

As described above in connection with the gaming machine 206, in one example, the gaming server 208 and the user device 210 are programmed accordingly, such as with the processor(s) 92 and the memory 94, to allow a player to access and play the card game in accordance with the embodiments disclosed herein. In this regard, the gaming server 208 is programmed to execute a set of server-side based functions, while the user device 210 is programmed to execute a set of client-side based functions. In one scenario, players at multiple user devices 210 could participate in the same game. However, in other examples, the entire game program logic (e.g., the program instructions 110 held in the memory 94) could also or instead be embedded entirely within the user device 110, such as in a scenario in which only one player is playing the game.

Figure 7:
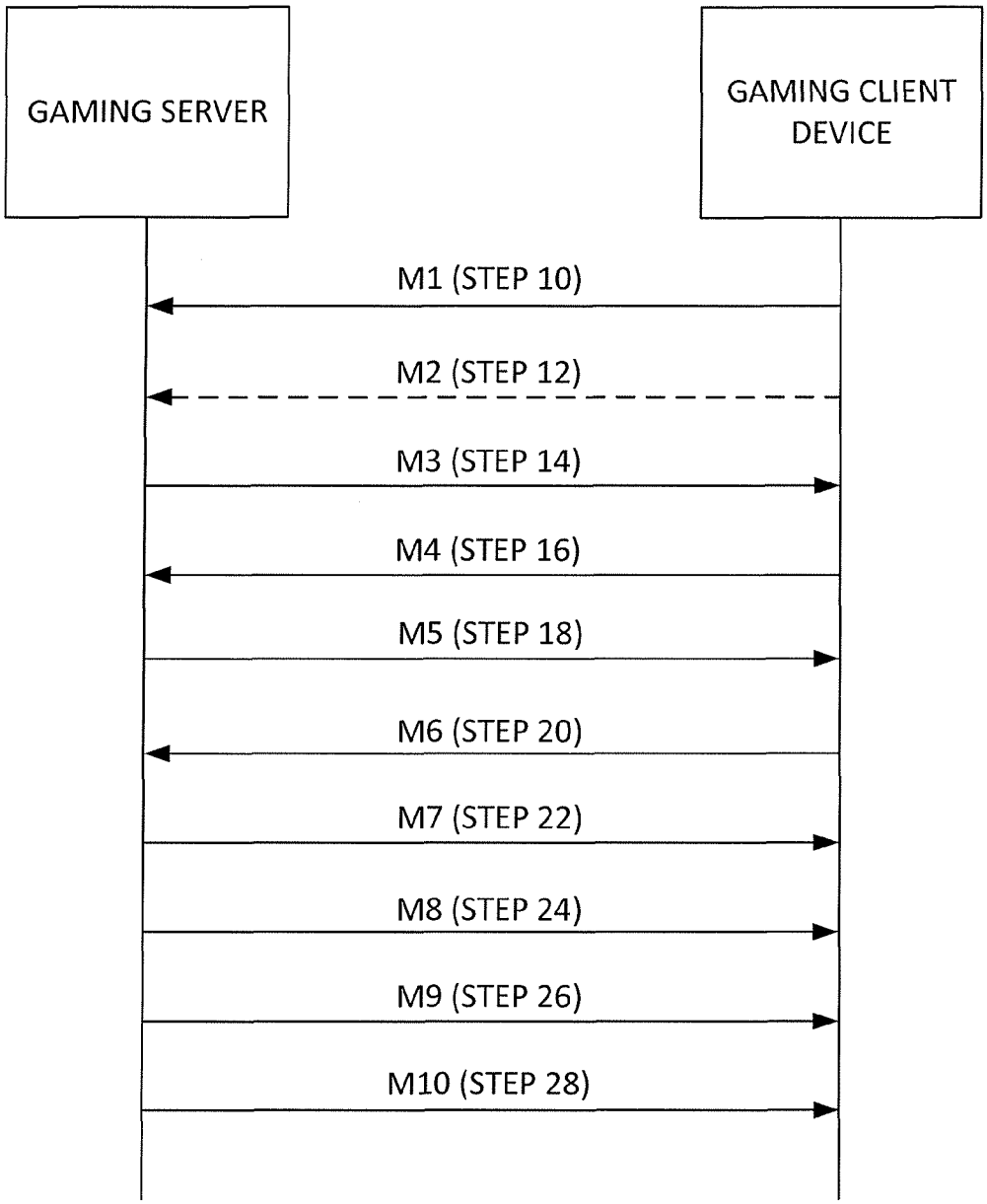
FIG. 7 illustrates an example of a message exchange between a gaming server and a gaming client device, in accordance with one embodiment.

FIG. 7 illustrates an example of message exchange that is carried out between the gaming server 208 and a gaming client device, such as the gaming machine 206 or the user device 210, in accordance with one embodiment. As shown in the example of FIG. 7, a set of messages M1-M10 may be exchanged between the gaming server 208 and the gaming client device. In the present embodiment, each of the messages M1-M10 include an instruction corresponding to respective steps 10-28 in FIG. 1 and also includes the associated data, including information regarding dealt cards, bets, hand ranking, and payout. As noted above, the gaming server 208 is programmed accordingly to execute a set of server-side based functions, while the gaming client device is programmed to execute a set of client-side based functions.

As discussed above, however, in various embodiments the entire game program logic could also or instead be embedded entirely within the gaming client device or may be apportioned among the gaming client device and one or more gaming servers. In the embodiment where the entire game program logic is embedded entirely within the gaming client device, such as in the form a client gaming application, a user plays the game for points or accumulates points with subsequent plays.

Example of a User Device with a Gaming Application

Figure 8:
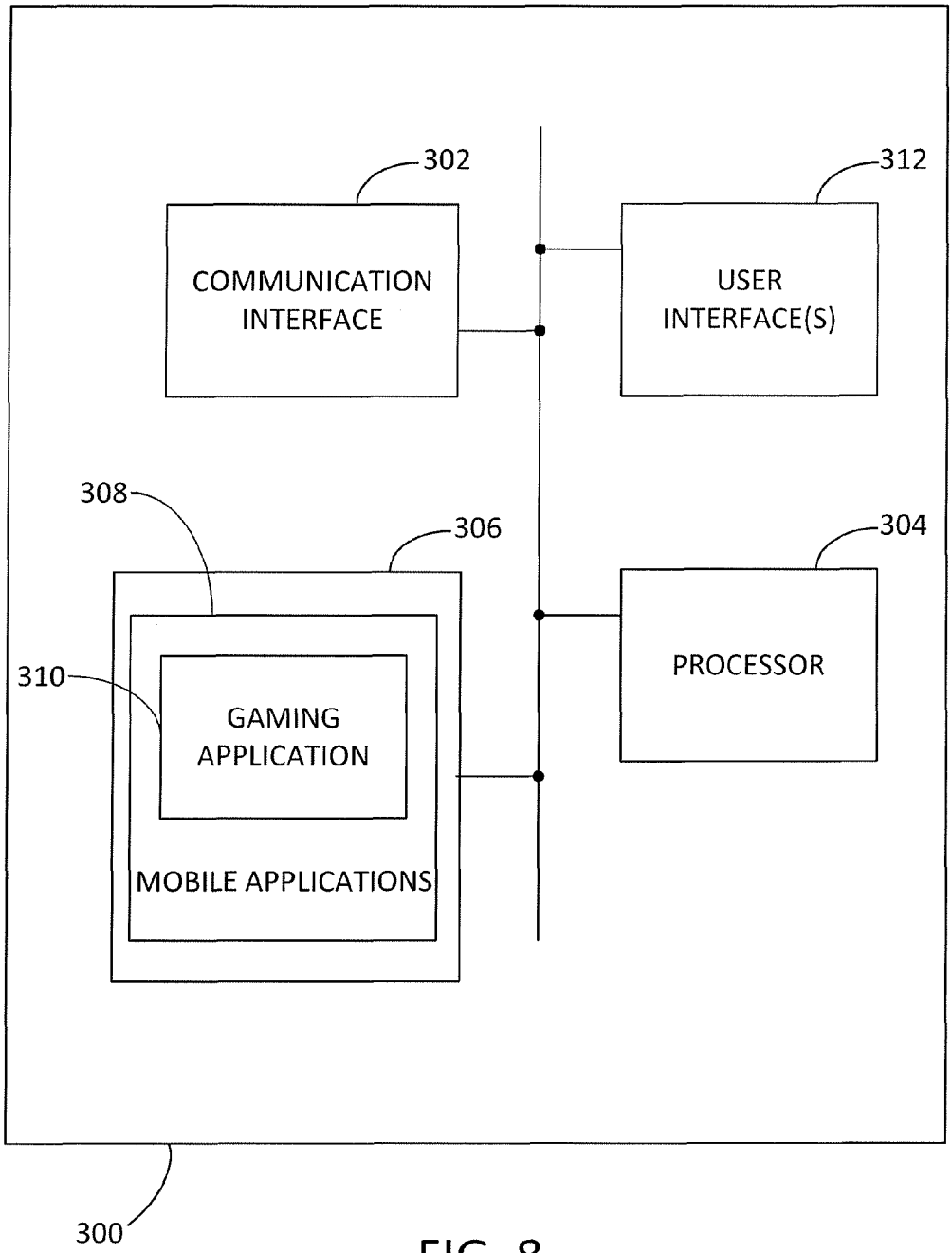
FIG. 8 illustrates an example of a user device configured to run a gaming application in accordance with one embodiment.

FIG. 8 illustrates an example of a user device 300 having thereon a gaming application in accordance with one embodiment. In the illustrated embodiment, the user device 300 is a wireless mobile device (e.g., an iPhone®) having a communication interface 310 compatible with appropriate wireless protocol(s). The user device 300 also includes a processor 304 configured to execute computer readable instructions stored in memory 306, including program instructions for mobile applications 308, such as a gaming application 310. The program instructions for the gaming application 310 include program instructions for at least some of various functions described herein, such all or a subset of the steps of the method discussed above in connection with FIG. 1. The user device 300 further includes user interface(s) 312 (e.g., a touch screen, a keyboard, a stylus pen, a display, etc.), including any suitable interface(s) for receiving user input (e.g., betting inputs) and displaying various content to a user, including, e.g., graphical/virtual representations of a table, such as the game table and cards thereon. Of course, the user device 300 may include various other components not described and depicted in FIG. 8.

CONCLUSION

Embodiments of the present application have been described above. Those skilled in the art will understand, however, that changes and modifications may be made to these embodiments without departing from the true scope and spirit of the present application, which is defined by the claims.

What is claimed is:

1. A dedicated electronic gaming table that is able to host a plurality of players and comprising an electronic processor, an electronic memory, an electronic input device, and an electronic display which serves as a gaming surface and a horizontal table surface, the memory, the input device, and the display being coupled to the processor, the memory storing computer readable instructions for the processor which when executed by the processor cause the gaming table to perform a method for playing a card game, the method comprising the steps of:

after receiving, via the input device, an ante bet input and an optional blind eye bonus bet input from one of the players, presenting, via the display, graphical representations of first hole card set and a blind eye hole card set on the gaming surface, wherein each member of the first hole card set faces up, the blind eye hole card set including a face down card and a face up card, the optional blind eye bonus bet input associated with at least one of the first hole card set or the blind eye hole card set;

after receiving, via the input device, either one of a fold input or a hand bet input from the one player, presenting, via the display, a graphical representation of a flop card set on the gaming surface while the graphical representations of the first hole card set and the blind eye hole card set are presented on the gaming surface, each member of the flop card set facing up, the fold input being associated with the first hole card set, and the hand bet input being associated with at least one of the first hole card set or the blind eye hole card set;

after receiving, via the input device, a play bet input after the flop card set is presented, presenting, via the display, graphical representations of a turn card and a river card on the gaming surface, each of the turn card and the river card facing up;

revealing, via the display, the face down card on the gaming surface as the turn card and the river card are presented on the gaming surface;

determining, based on the revealing, a highest-ranked poker hand presented on the gaming surface based on a combination of a hole card set with the flop card set, the turn card, and the river card, the hole card set including at least one of the first hole card set or the blind eye hole card set;

after determining, irrespective of the fold input, whether the optional blind eye bonus bet input qualifies for a payout value, determining, the payout value associated with the ante bet input, the optional blind eye bonus bet input, the hand bet input, and the play bet input received on the highest-ranked poker hand;

generating, an electronic message informative of the highest-ranked poker hand and the payout value; and presenting, via the display, the message.

2. The electronic gaming table of claim 1, wherein the payout value is higher for the blind eye hole card set than for the first hole card set.

3. The electronic gaming table of claim 1, wherein the payout value for the optional blind eye bonus bet input and the hand bet input in combination with the flop card set results in a predetermined minimum hand ranking value.

4. The electronic gaming table of claim 1, wherein the blind eye hole card set consists of two cards.

5. The electronic gaming table of claim 1, wherein the graphical representations of the turn card and the river card are simultaneously presented on the gaming surface before the revealing.

6. The electronic gaming table of claim 1, wherein the optional blind eye bonus bet input is associated with the first hole card set.

7. The electronic gaming table of claim 1, wherein the optional blind eye bonus bet input is associated with the blind eye hole card set.

8. The electronic gaming table of claim 1, wherein the optional blind eye bonus bet input associated with the first hole card set and the blind eye hole card set.

9. The electronic gaming table of claim 1, wherein the method further comprises:

presenting, via the display, a graphical representation of a second hole card set on the gaming surface, wherein each member of the second hole card set faces up, wherein the hole card set includes the second hole card set.

10. A gaming apparatus comprising an electronic processor, an electronic memory, an electronic input device, an electrical user betting input device, and an electronic display which serves as a gaming surface, the memory, the input device, the user betting device, and the display being coupled to the processor, the memory storing a set of computer readable instructions for the processor which when executed by the processor cause the gaming apparatus to perform a method for playing a card game, the method comprising the steps of:

receiving, via the user betting device, a betting input from a player;

after receiving, via the input device, an ante bet input and an optional blind eye bonus bet input from the player, presenting, via the display, graphical representations of a first hole card set and a blind eye hole card set on the gaming surface, each member of the first hole card set facing up, the blind eye hole card set including a face down card and a face up card, and the optional blind eye bonus bet input being associated with at least one of the first hole card set or the blind eye hole card set;

after receiving, via the input device, either one of a fold input or a hand bet input from the player, presenting, via the display, a graphical representation of a flop card set on the gaming surface while the graphical representations of the first hole card set and the blind eye hole card set are presented on the gaming surface, each member of the flop card set facing up, the fold input being associated with the first hole card set, and the hand bet input being associated with at least one of the first hole card set or the blind eye hole card set;

after receiving, via the input device, a play bet input after the flop card set is presented, presenting, via the display, graphical representations of a turn card and a river card on the gaming surface, each of the turn card and the river card facing up;

revealing, via the display, the face down card on the gaming surface as the turn card and the river card are presented on the gaming surface;

determining, based on the revealing, a highest-ranked poker hand presented on the gaming surface based on a combination of a hole card set, with the flop card set, the turn card, and the river card, the hole card set including at least one of the first card set or the blind eye hole card set;

after determining, irrespective of the fold input, whether the optional blind eye bonus bet input qualifies for a payout value, determining, the payout value associated with the ante bet input, the optional blind eye bonus bet input, the hand bet input, and the play bet input received on the highest-ranked poker hand;

generating, an electronic message informative of the highest-ranked poker hand and the payout value; and presenting, via the display, the message.

11. The gaming apparatus of claim 10, wherein the payout value is higher for the second hole card set than for the first hole card set.

12. The gaming apparatus of claim 10, wherein the payout value for the blind eye bonus bet input and the hand bet input in combination with the flop card set results in a predetermined minimum hand ranking value.

13. The gaming apparatus of claim 10, wherein the second hole card set consists of two cards.

14. The gaming apparatus of claim 10, wherein the graphical representations of the turn card and the river card are simultaneously presented on the gaming surface before the revealing.

15. The gaming apparatus of claim 10, wherein the optional blind eye bonus bet input is associated with the first hole card set.

16. The gaming apparatus of claim 10, wherein the optional blind eye bonus bet input is associated with the blind eye hole card set.

17. The gaming apparatus of claim 10, wherein the optional blind eye bonus bet input associated with the first hole card set and the blind eye hole card set.

18. The gaming apparatus of claim 10, wherein the method further comprises:

presenting, via the display, a graphical representation of a second hole card set on the gaming surface, wherein each member of the second hole card set faces up, wherein the hole card set includes the second hole card set.

19. A storage device storing a set of electronic processor-executable instructions which when executed by the processor cause the processor to perform a method for playing a card game involving a user betting input device, an electronic input device, and an electronic display, the processor being coupled to the user betting input device, the input device, and the display, the method comprising the steps of:

receiving, via the user betting input device, a user betting input from a player;

after receiving, via the input device, an ante bet input and an optional blind eye bonus bet input from the player, presenting, via a display, graphical representations of a first hole card set and a blind eye hole card set on the display, each member of the first hole card set facing up, the blind eye hole card set including a face down card and a face up card, the optional blind eye bonus bet input being associated with at least one of the first hole card set or the blind eye hole card set, and the input device and the display being in communication with the one or more processors;

after receiving, via the input device, either one of a fold input or a hand bet input from the player, presenting, via the display, a graphical representation of a flop card set on the display while the graphical representations of the first hole card set and the blind eye hole card set are presented on the display, each member of the flop card set facing up, the fold input being associated with the first hole card set, and the hand bet input being associated with at least one of the first hole card set or the blind eye hole card set;

after receiving, via the input device, a play bet input after the flop card set is presented, presenting, via the display, graphical representations of a turn card and a river card on the display, each of the turn card and the river card facing up;

revealing, via the display, the face down card on the display as the turn card and the river card are presented on the display;

determining, based on the revealing, a highest-ranked poker hand presented on the display based on a combination of a hole card set, with the flop card set, the turn card, and the river card, the hole card set including at least one of the first card set or the blind eye hole card set;

after determining, irrespective of the fold input, whether the optional blind eye bonus bet input qualifies for a payout value, determining, the payout value associated with the ante bet input, the optional blind eye bonus bet input, the hand bet input, and the play bet input received on the highest-ranked poker hand;

generating, an electronic message informative of the highest-ranked poker hand and the payout value; and presenting, via the display, the message.

20. The storage device of claim 19, wherein the payout value is higher for the second hole card set than for the first hole card set.

21. The storage device of claim 19, wherein the payout value for the blind eye bonus bet input and the hand bet input in combination with the flop card set results in a predetermined minimum hand ranking value.

22. The storage device of claim 19, wherein the second hole card set consists of two cards.

23. The storage device of claim 19, wherein the turn card and the river card are simultaneously presented on the display before the revealing.

24. The storage device of claim 19, wherein the optional blind eye bonus bet input is associated with the first hole card set.

25. The storage device of claim 19, wherein the optional blind eye bonus bet input is associated with the blind eye hole card set.

26. The storage device of claim 19, wherein the optional blind eye bonus bet input associated with the first hole card set and the blind eye hole card set.

27. The storage device of claim 19, wherein the method further comprises:

presenting, via the display, a second hole card set to all players of the card game, wherein each member of the second hole card set faces up, wherein the hole card set includes the second hole card set.

28. A method of serving, from an electronic game server with an electronic processor, a card game involving a player associated with an electronic input device of an electronic gaming client having an electronic display, the method comprising:

after receiving, from the gaming client, an electronic message indicative of an ante bet input and an optional blind eye bonus bet input from the player, sending to the gaming client an electronic message effecting the presentation, via the display of the gaming client, of graphical representations of a first hole card set and a blind eye hole card set on the display, each member of the first hole card set facing up, the blind eye hole card set including a face down card and a face up card, the optional blind eye bonus bet input being associated with at least one of the first hole card set or the blind eye hole card set, and the input device and the display being in communication with one or more processors;

after receiving an electronic message from the game client indicative of either one of a fold input or a hand bet input from the player, sending to the gaming client an electronic message effecting presentation of, via the display, a graphical representation of a flop card set on the gaming surface while the graphical representations of the first hole card set and the blind eye hole card set are presented on the display, each member of the flop card set facing up, the fold input being associated with the first hole card set, and the hand bet input being associated with at least one of the first hole card set or the blind eye hole card set;

after receiving from the gaming client, an electronic message indicative of a play bet input after the flop card set is presented, sending to the gaming client an electronic message effecting presentation of, via the display, a graphical representation of a turn card and a river card, each of the turn card and the river card facing up;

revealing, via the display of the gaming client, the face down card on the gaming surface as the turn card and the river card are presented on the gaming surface;

determining, via the processor of the game server, based on the revealing, a highest-ranked poker hand presented on the display based on a combination of a hole card set, with the flop card set, the turn card, and the river card, wherein the hole card set includes at least one of the first card set or the blind eye hole card set;

after determining, via the processor of the game server, irrespective of the fold input, whether the optional blind eye bonus bet input qualifies for a payout value, determining, via the processor of the game server, the payout value associated with the ante bet input, the optional blind eye bonus bet input, the hand bet input, and the play bet input received on the highest-ranked poker hand;

generating, via the processor of the game server, an electronic message informative of the highest-ranked poker hand and the payout value; and sending to the gaming client the electronic message and effecting presentation, via the display of the message.

29. The method of claim 28, wherein the payout value is higher for the second hole card set than for the first hole card set.

30. The method of claim 28, wherein the payout value for the blind eye bonus bet input and the hand bet input in combination with the flop card set results in a predetermined minimum hand ranking value.

31. The method of claim 28, wherein the second hole card set consists of two cards.

32. The method of claim 28, wherein the graphical representations of the turn card and the river card are simultaneously presented on the gaming surface before the revealing.

33. The method of claim 28, wherein the optional blind eye bonus bet input is associated with the first hole card set.

34. The method of claim 28, wherein the optional blind eye bonus bet input is associated with the blind eye hole card set.

35. The method of claim 28, wherein the optional blind eye bonus bet input associated with the first hole card set and the blind eye hole card set.

36. The method of claim 28, wherein the method further comprises:

sending to the gaming client and electronic message effecting presentation of, via the display, a graphical representation of a second hole card set on the gaming surface to all players of the card game, wherein each member of the second hole card set faces up, wherein the hole card set includes the second hole card set.

* * * * *